United States Patent [19]

Jackson et al.

[11] Patent Number: 4,940,298

[45] Date of Patent: Jul. 10, 1990

[54] PLASTIC DISHWASHER TUB AND SUPPORT STRUCTURE

[75] Inventors: James R. Jackson; Stephen H. Friskney, both of Connersville, Ind.

[73] Assignee: White Consolidated Industries, Inc., Cleveland, Ohio

[21] Appl. No.: 367,730

[22] Filed: Jun. 19, 1989

[51] Int. Cl.[5] ..... A47B 77/06

[52] U.S. Cl. ..... 312/228; 312/254

[58] Field of Search ..... 312/228, 276, 254, 255, 312/256; 248/500

[56] References Cited

U.S. PATENT DOCUMENTS

| | | | |
|---|---|---|---|
| 2,024,010 | 12/1935 | Muckler | 312/276 |
| 4,336,619 | 6/1982 | Hinkel et al. | 312/228 X |
| 4,359,250 | 11/1982 | Jenkins | 312/228 |
| 4,441,770 | 4/1984 | Brezosky | 312/276 |
| 4,746,177 | 5/1984 | Lampman et al. | 312/228 |

*Primary Examiner*—Joseph Falk

*Attorney, Agent, or Firm*—Pearne, Gordon, McCoy & Granger

[57] ABSTRACT

A plastic dishwasher tub and support structure is disclosed. A single piece is formed into a rear frame that attaches to the door frame of the dishwasher. The rear frame is in an inverted U-shape with arms formed by bending a portion of the legs of the U out of the plane of the U. The bight of the U supports the rear of the tub while the arms attach to the door frame and serve as skids for the dishwasher. The plastic tub is formed with integral reinforcing ribs on the tub portion to bear against the rear frame. In addition, retention blocks are cantilevered from the tub bottom to extend below the reinforcing ribs. The bight of the rear frame sides into the space between the blocks and ribs during assembly and prevents up and down and fore and aft movement of the tub with respect to the frame. Strips are placed on the jambs of the door frame astride the counterbalance levers on the door. These strips limit the travel of the door in the open position. The door frame is formed from a U-shaped length of angle iron. The door frame engages ribs integrally formed on the top and sides of the tub, parallel to the open front.

14 Claims, 9 Drawing Sheets

PLASTIC DISHWASHER TUB AND SUPPORT STRUCTURE

BACKGROUND OF THE INVENTION

The invention relates to dishwashers, particularly to plastic tub dishwashers.

The use of plastic as a tub material offers many advantages. Among these advantages are more economical tub construction, increased tub life and lower weight.

To exploit these advantages to the fullest extent, it is necessary to develop tub and hardware mounting structures that further minimize weight, material and manufacturing costs while at the same time providing sufficient support and structural stiffness to prevent premature tub failure.

U.S. Pat. No. 4,359,250 discloses a plastic dishwasher tub and frame assembly and is incorporated in its entirety herein by reference. The patent sets forth a plastic tub supported by a metal frame. The frame comprises a main frame portion made from a piece of U-channel bent in a U-shape supporting the front portion of the tub and two U-channels bent into right angles supporting the rear portion of the tub. One end of each right-angle bent U-channel is attached at the base of the jamb at each side of the door frame and the other end is retained in a pocket formed in the bottom of the tub at respective sides of the tub. A piece of angle iron is attached between the two right-angle bent U-channels so that it abuts the tub bottom to provide additional support for the rear of the tub.

Fabrication of the support for the rear of the tub requires three separate pieces. The two right-angle bent U-channel pieces must be formed and the angle iron attached between them. Fabrication of the frame members also requires the forming of a length of U-channel. The bending of a length of U-channel into a U-shape is difficult because of the tendency of the sides of the U to bend or buckle during the forming operation. Furthermore, there is a problem in securing the plastic tub to the metal frame because the softness of the plastic as compared to metal requires substantial contact area to avoid deformation of the plastic in the contact areas.

It is well known in the art to provide a front-loading dishwasher with a downwardly opening door having counterbalance springs. The door is hinged to the door frame by hinge arms on the sides of the door. These hinge arms have extensions that serve as levers for mounting one end of the counterbalance springs. To limit the travel of the door in the open position (typically a horizontal position), prior art dishwashers employ a rigid tab or similar projection from the door frame as a door stop to limit the hinged rotation of the hinge arms.

This tab or projection as well as the door frame must possess substantial resistance to the bending moment produced when the hinge arm swings against the tab. This is particularly true when a user rolls a rack full of dishes out onto the open door. This requires the tab or projection and at least an area on the door frame about the tab or projection to be of substantial thickness.

SUMMARY OF THE INVENTION

The present invention provides a new and improved tub and support structure that overcomes the problems associated with past designs.

The dishwasher comprises a tub supported by a frame, where the tub may advantageously be formed of a thermoplastic material. The frame has a door frame about the open front of the tub that supports the tub in front and a one piece rear support formed from a single piece that supports the rearward portion of the tub.

The use of a one piece rear support reduces the fabrication and assembly costs over prior designs.

The rear support may be advantageously formed from an essentially straight piece into an inverted U with the ends of the legs formed into arms extending out of the plane of the U.

The rear support is preferably stretch formed from a length of low carbon steel having an angle cross section with legs of unequal length. In the preferred embodiment, the ends of the arms are attached near the bottom of the door frame and the rear of the tub rests on the bight of the U-shape with the arms resting on the support surface.

The new plastic tub of the invention includes a series of support pads or ribs integrally formed in the bottom surface of the tub bottom. These ribs distribute the weight of the rearward portion of the tub onto the rear support while still allowing the inside of the tub to be sloped to the drain. Rather than a series of pads or ribs, a continuous pad may be used.

The tub may advantageously be further provided with a series of retention blocks integrally formed in the bottom surface of the tub bottom and cantilevering therefrom to extend below at least a portion of the rear support. During assembly, a projecting angle leg of the bight of the rear support is slid between the ribs and the blocks. This then prevents up and down as well as fore and aft movement of the tub with respect to the frame once the rear support is attached to the door frame. Rather than a series of blocks, a single continuous block may be used or the blocks may be narrow ribs.

One or more of the retention blocks may be advantageously formed with a key portion and the rear support provided with a slot or keyway to receive the key during assembly. When the key is received in the keyway, the rear of the tub is restrained from side to side movement with respect to the rear support.

The dishwasher of the invention may advantageously be provided with a strip mounted at its ends to the door frame astride each counterbalance arm of the door hinge. When the counterbalance arms or extensions swing against the attached strip ends, the travel of the door is stopped at the fully open position. Because the strip is restrained at both ends and defines with the door frame a narrow guide slot, any bending or lateral deflection of the counterbalance arm is prevented and the arm may be of a thinner material. In addition, the strips keep the extensions from interfering with cabinetry and similar structures at the sides of the dishwasher.

It is further advantageous to form the offsets such that the bend of the top offset is parallel to the portion of the counterbalance arm that contacts the strip in the fully open position. By thus maximizing the contact area between the arm and the strip, the minimum thickness material may be used for the arm as the tendency of the arm to shear the strip is minimized.

The door frame of the invention may advantageously be formed from a length of metal of angular cross section bent in a U-shape. One of the angle arms extends towards the interior of the U. One or more ribs are integrally formed on the top and sides of the tub near the open front and the inside of the other angle arm of the door frame is received against the ribs, largely enclosing same. The ribs are of a height such that the end of the interior extending angle arm is received against the top and sides of the tub.

The integral rib allows the tub to gain structural strength from the rib itself, from the angle arm in contact with the rib and from the angle arm in contact with the tub walls. It is of course be possible to make the ribs such that no contact is made between the tub walls and the interior extending angle arm.

Bosses may be advantageously formed either integral with, or adjacent to, the ribs to provide attachment points for affixing the door frame to the tub.

DESCRIPTION OF THE PREFERRED EMBODIMENT

Figure 1:
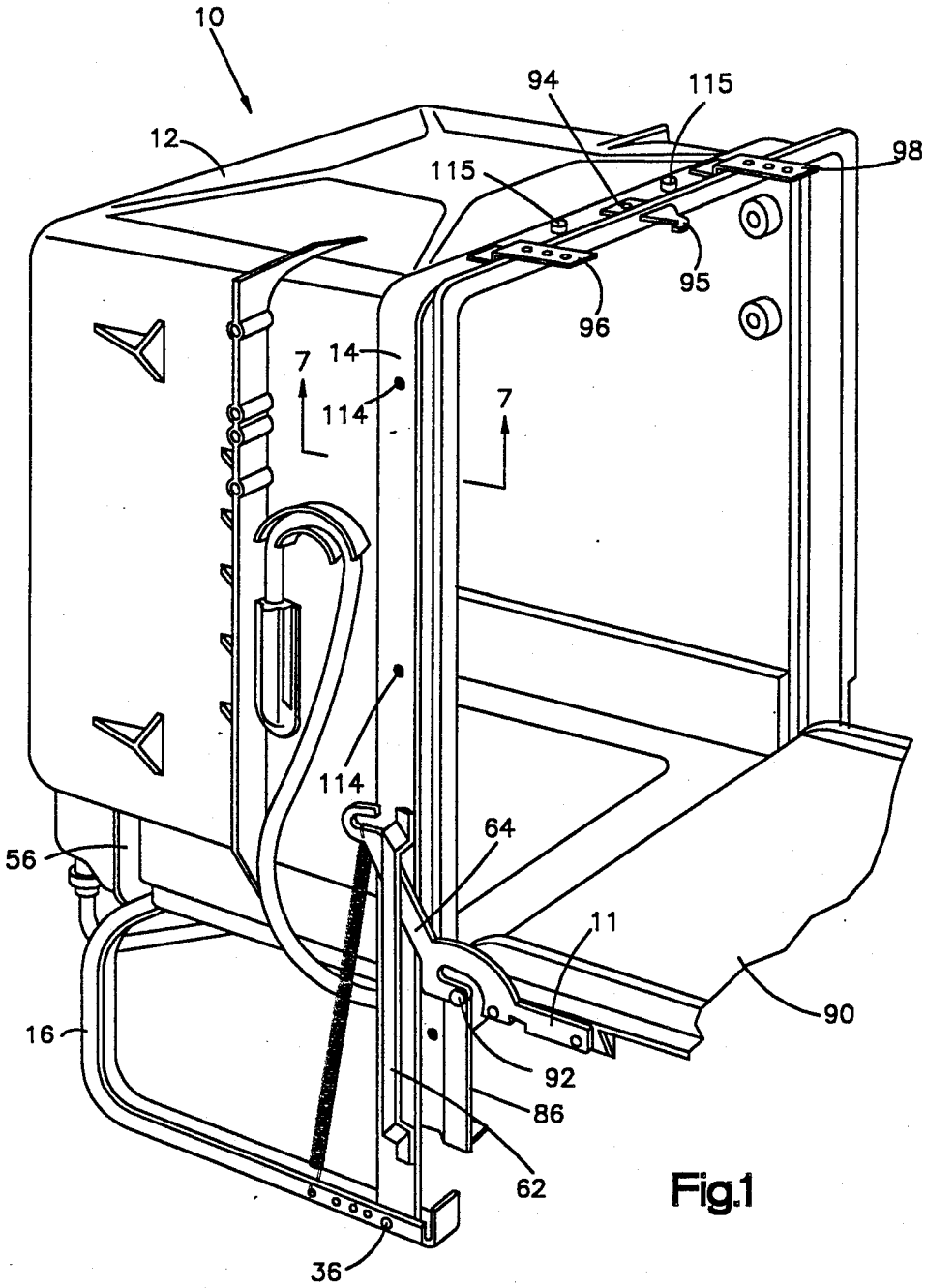
FIG. 1 is a perspective view of the dishwasher of the invention.

FIG. 1 illustrates a dishwasher 10 according to the present invention. A unitary molded plastic tub 12 is supported by door frame 14 and rear support 16. Preferably the tub 12 is injection molded in one piece from mineral-filled polypropylene.

Figure 2A:
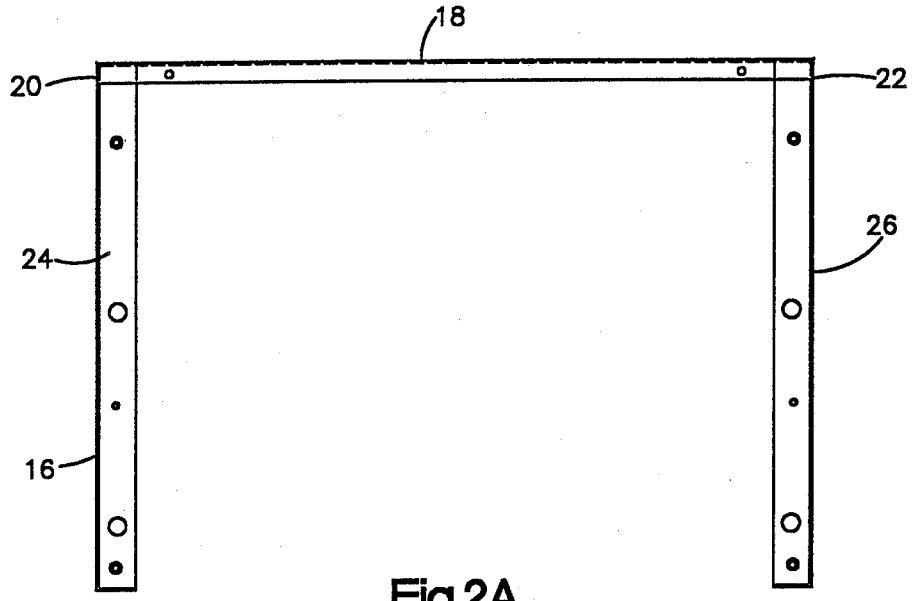
FIGS. 2A, 2B and 2C respectively show a plan view, a front elevation view and a side elevation view of the rear support of the dishwasher.
Figure 2B:
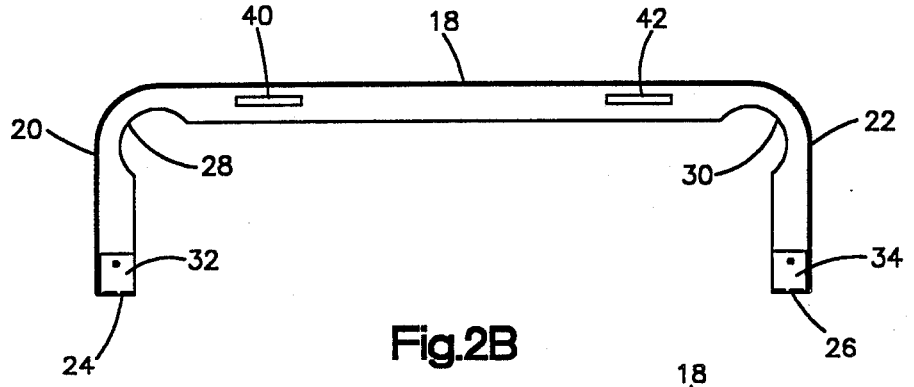
Figure 2C:
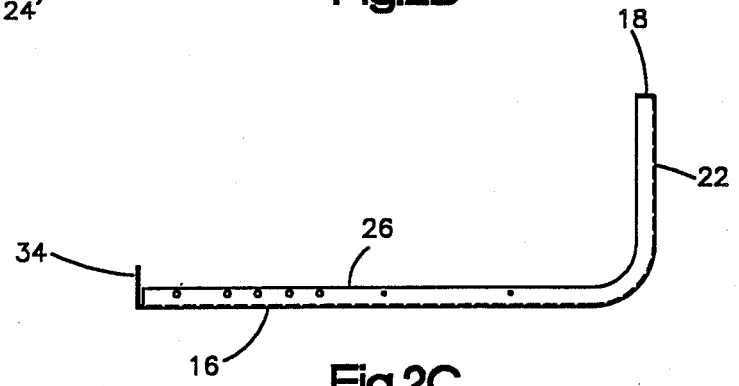
Figure 3A:
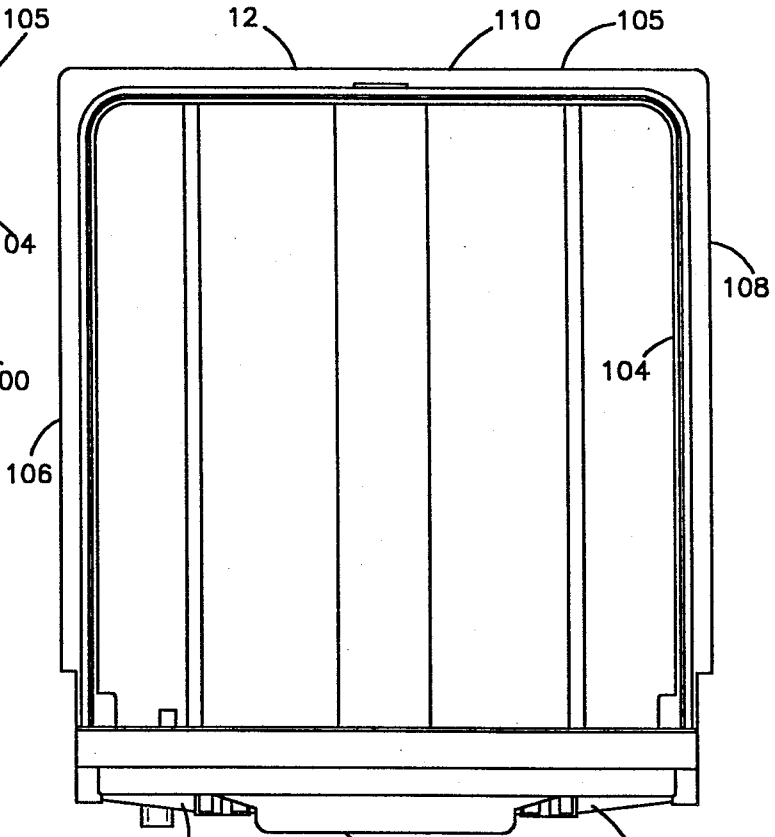
FIGS. 3A, 3B, 3C, 3D, 3E, and 3F are front elevation, right side elevation, rear elevation, left side elevation, top plan and bottom plan views, respectively, of the tub of the invention.
Figure 3D:
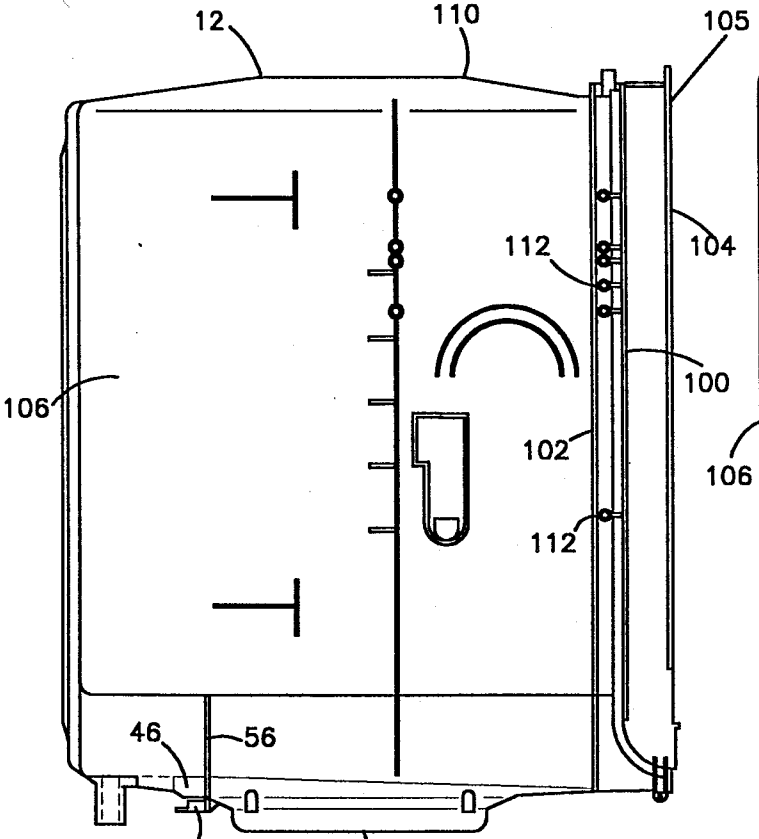
Figure 3C:
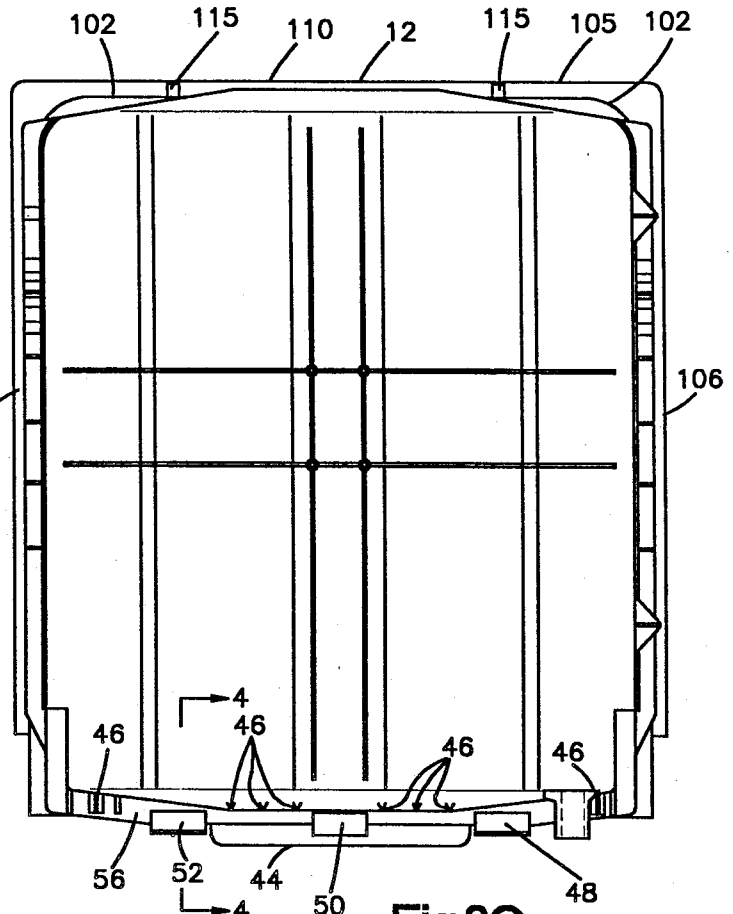
Figure 3B:
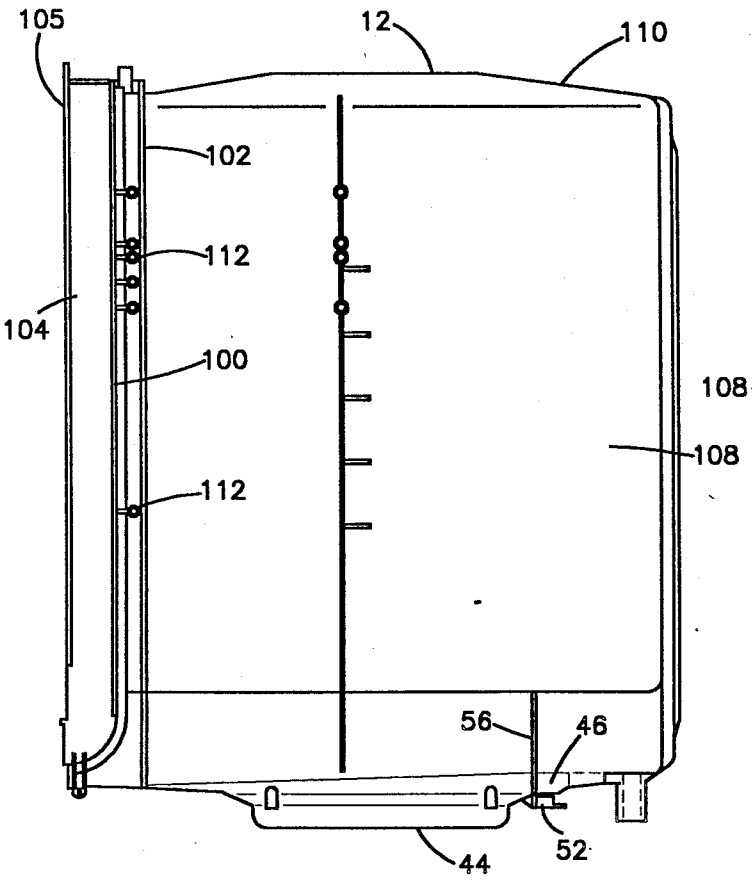
Figure 3F:
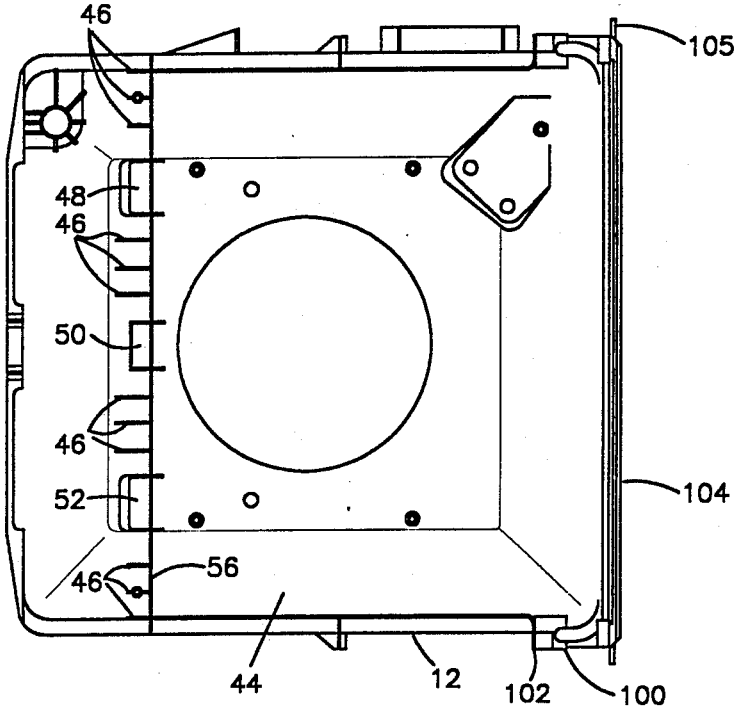
Figure 3E:
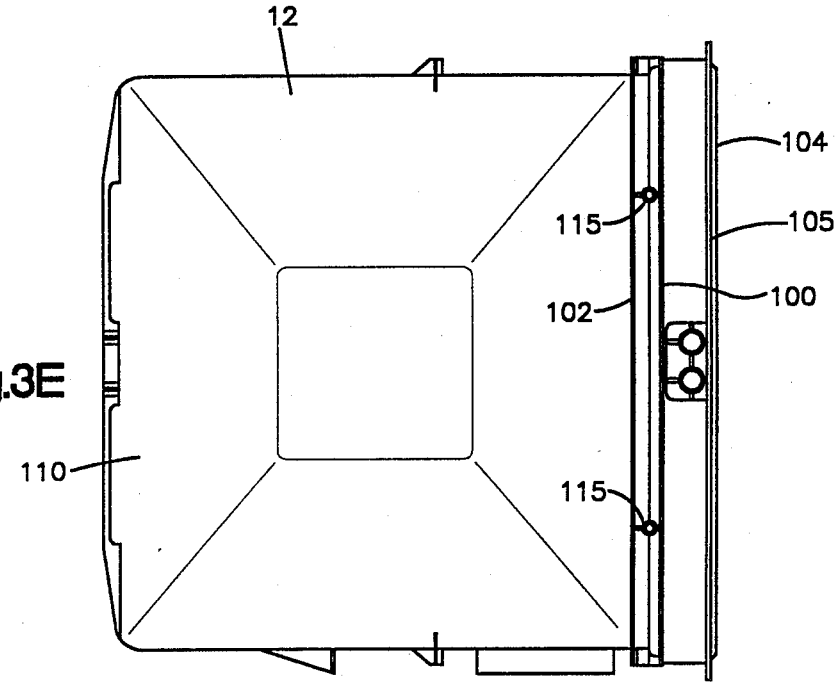

FIGS. 2A, 2B, and 2C respectively show a plan view, a front elevation view and a side elevation view of rear support 16. Rear support 16 is formed from a single length of steel bar having an angular cross section with legs of unequal length with one leg preferably twice the length of the other.

The length of metal is formed into a U-shape with bight 18 and vertical legs 20, 22. The end portions of legs 20, 22 are formed into horizontal arms 24, 26, respectively, which extend perpendicularly out of the plane of the U.

In the preferred embodiment using the angle described above, the shorter leg of the angle is at the outside periphery of the U and the longer leg is in the plane of the U. Arms 24, 26 then extend out of the plane of the U with the longer leg of the angle on the bottom. Cutouts 28, 30 may be provided at the insides of the bends forming the U to facilitate the forming process. The tips 32, 34 of arms 24, 26, respectively, may be bent at right angles to arms 24, 26 to provide a mounting surface for a conventional front cover (not shown).

In the preferred embodiment, arms 24, 26 rest on the floor or other mounting surface (leveling feet may also be mounted on arms 24, 26 between the arms and the floor) with an outside flat of the angle being parallel to the mounting surface. The rear portion of tub 12 rests upon bight 18. Arms 24, 26 are attached to door frame 14 near the bottom by, for example, bolt 36 (see FIG. 1) and a similar bolt at the opposite side of door frame 14. Bight 18 may be advantageously provided with openings or keyways 40, 42 extending through the flat in the plane of the U. Keyways 42, 44 may, for example, be rectangular.

Referring to FIGS. 3A–3F, tub bottom 44 is provided with integrally molded ribs 46 extending downward therefrom. Ribs 46 are formed with such a length that uniform contact is made with bight 18.

Figure 5:
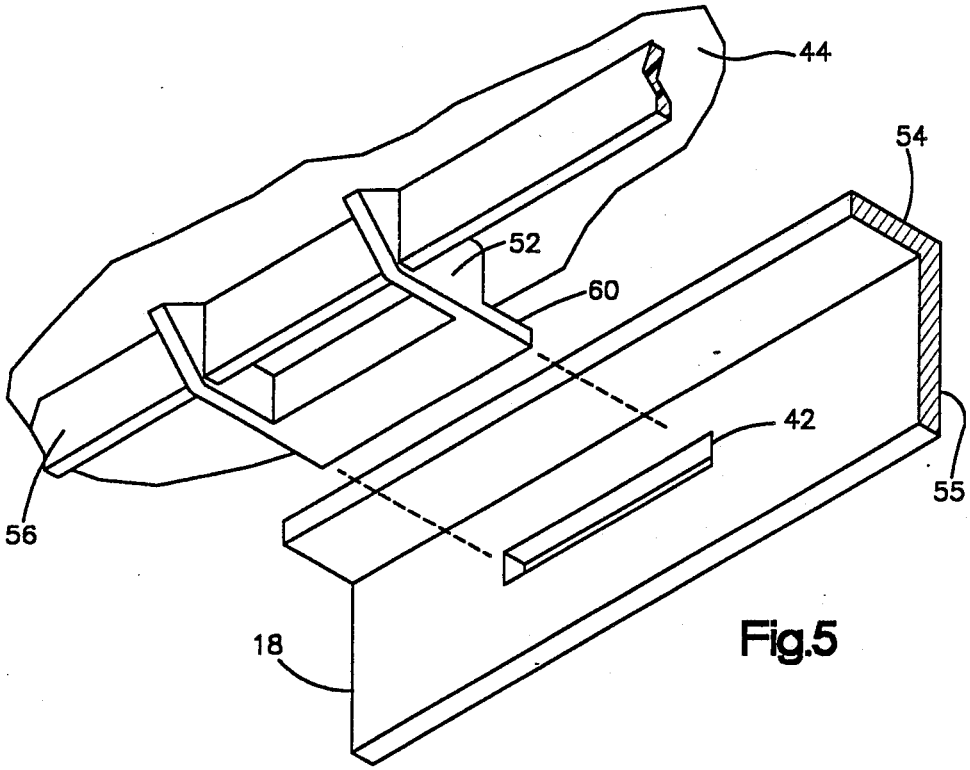
FIG. 5 is an exploded partial perspective view of the rear support and the engaging structures located on the lower surface of the tub.
Figure 4:
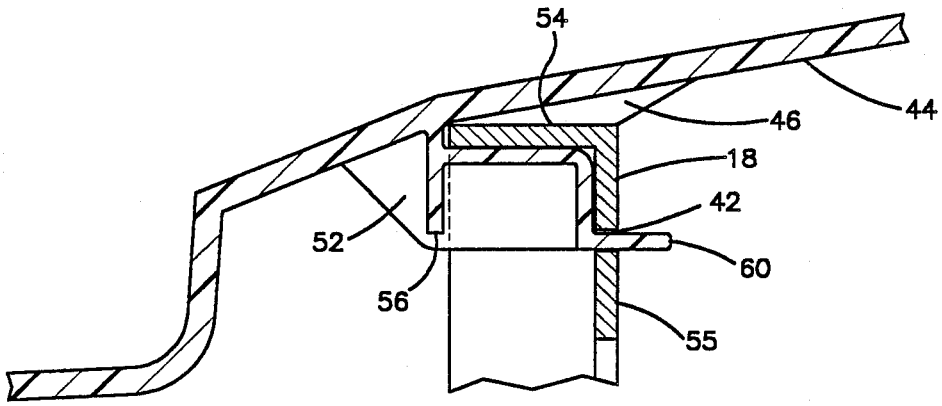
FIG. 4 is a cross-sectional view through line 4—4 in FIG. 3C with the rear support added.

Retention blocks 48, 50, 52 are also integrally molded with tub bottom 44. Blocks 48, 50, 52 are cantilevered from bottom 44 to receive at least a portion of bight 18 in a slot defined between blocks 48, 50, 52 and ribs 46. In the preferred embodiment as shown for block 52 in FIGS. 4 and 5, blocks 48, 50, 52 extend underneath the horizontal leg 54 of the angle comprising bight 18. Blocks 48, 50, 52 are arranged such that when ribs 46 rest on bight 18, leg 54 is held snugly between the ribs and blocks. In addition, at least a portion of blocks 48, 50, 52 bear against the vertical flat 55 of bight 18. This prevents up-and-down and side-to-side movement of tub 12 with respect to rear support 16 when the rear support 16 is attached as described above to door frame 14.

Rib 56 may also be advantageously integrally formed with tub bottom 44, ribs 46 and blocks 48, 50, 52 to reinforce the same. Rib 56 extends between ribs 46 and blocks 48, 50, 52 and continues across tub bottom 44.

In the preferred embodiment, blocks 48, 52 are provided with keys 58, 60, respectively, extending therefrom toward the back of dishwasher 10. Keys 58, 60 are integrally formed with blocks 48, 50 and may, for example, be of a generally rectangular cross section slightly smaller than keyways 40, 42. Keys 58, 60 extend through keyways 40, 42 respectively, when dishwasher 10 is assembled. This prevents side-to-side movement of tub 12 with respect to rear support 16.

Figure 6C:
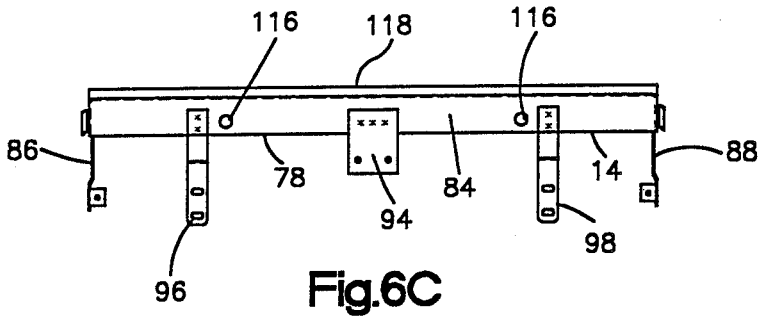
FIGS. 6A, 6B and 6C respectively show a front elevation view, a side elevation view and a top plan view of the door frame.
Figure 6A:
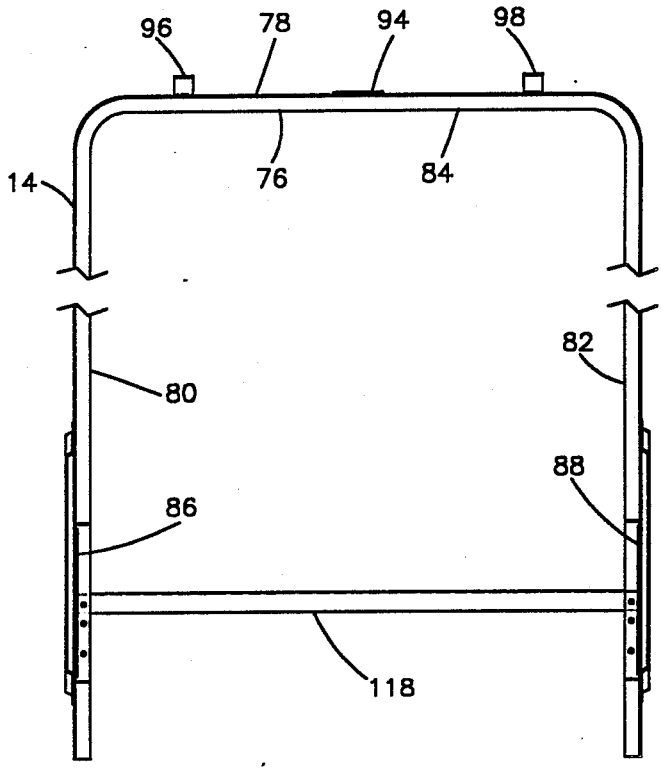
Figure 6B:
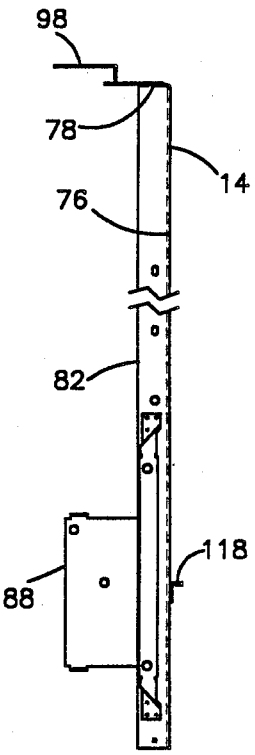

Referring to FIGS. 6A, 6B and 6C, door frame 14 of the invention is shown. Door frame 14 is formed from a length of steel bar similar to that used for rear support 16 having an essentially right-angle cross section having short inside angle arm 76 and a longer outside angle arm 78. Door frame 14 is in a U-shape comprising legs 80, 82 and bight 84. A substantial portion of legs 80, 82 and bight 84 are straight. Inside angle arm 76 is largely in the plane of the U and extending toward the interior thereof, while outside angle arm 78 is largely perpendicular to the plane of the U.

Hinge plates 86, 88 may be advantageously attached to outside arm 78 on legs 80, 82, respectively. Hinge plates 86, 88 may, for example, be attached by spot-welding to door frame 14. Door 90 may then be hinged on two hinge pins 92 (see FIG. 1, only one side shown) which pivotally mount hinge arms 11 (one shown) on hinge plates 86, 88.

Striker mounting plate 94 may be advantageously attached to outside arm 78 on bight 84 and striker 95 attached (e.g. by machine screws) to mounting plate 94 with tub 12 clamped therebetween. This provides rigid attachment of the top of tub 12 to door frame 14.

Striker 95 is adapted to latchingly receive a latch on door 90 (not shown) to retain door 90 in a closed position.

Mounting brackets 96, 98 may also be advantageously attached to outside arm 78 on bight 84 to provide means to attach dishwasher 10 to an unshown counter top.

Striker mounting plate 94 and brackets 96, 98 may, for example, be spot-welded to door frame 14.

Referring to FIGS. 3A–3F, ribs 100, 102 are shown disposed about front opening 104 and lip 105 thereof of dishwasher 10. Ribs 100, 102 are integrally formed with tub 12 on the outside of tub sides 106, 108 and tub top 110. Ribs 100, 102 are generally parallel to front opening 104 and are located a short distance behind lip 105. Ribs 100, 102 extend largely perpendicular from the outside of tub 12 and are largely coextensive with sides 106, 108 and top 110.

Figure 7:
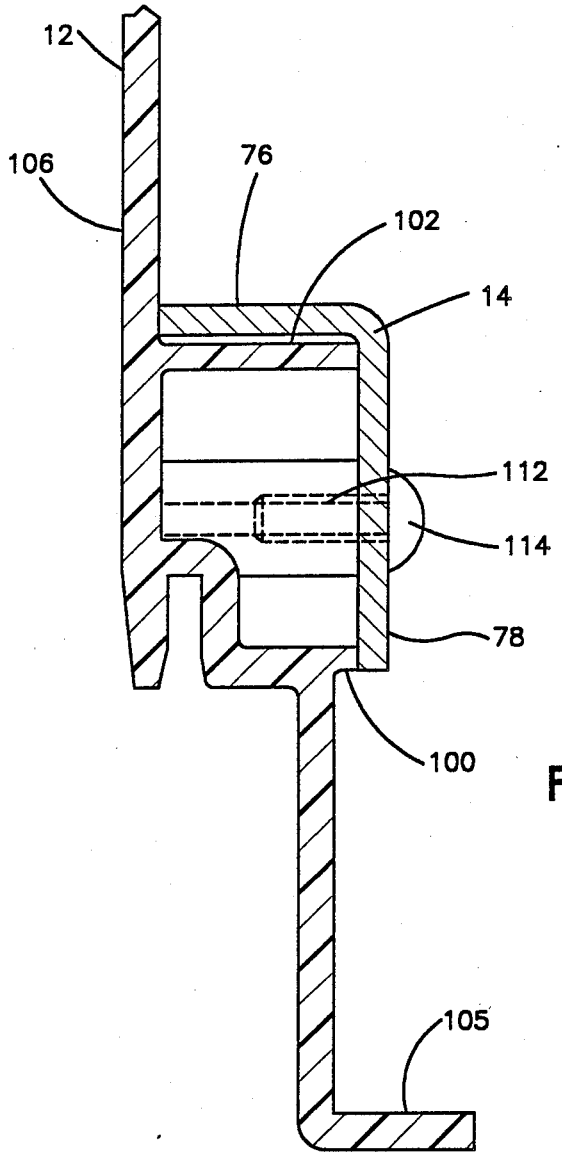
FIG. 7 is a fragmentary cross-sectional view of the engagement between the door frame and the tub along line 7—7 of FIG. 1.

When assembled, door frame 14 seats against ribs 100, 102 and thereby restrains tub 12. FIG. 7 shows an example cross section of door frame 14 in engagement with ribs 100, 102. In the preferred embodiment, ribs 100, 102 and/or inside angle arm 76 are of such dimensions that inside angle arm 76 engages the outer surface of tub 12 when outside angle arm 78 seats against ribs 100, 102. Ribs 100, 102, lip 105 and door frame 14 all increase the structural rigidity of tub 12.

It is of course possible to instead size ribs 100, 102 and/or inside angle arm 76 such that no contact is made between tub 12 and inside angle arm 76.

Tub 12 may also be provided with bosses 112 to permit the attachment of door frame 14 to tub 12 by, for example, screws 114 through outside arm 78 into bosses 112. Bosses 112 may be located between ribs 100, 102 on the outside of tub 12 or, optionally, formed integrally with ribs 100, 102.

Additionally, the outside surface of tub top 110 may be advantageously provided with keys 115 integrally molded therein and adapted to be received in keyways 116 located in outside arm 78 of bight 84 (FIG. 6C). This provides positive positioning during assembly.

It is of course possible to omit or redimension either rib 100 or 102 and instead engage outside arm 78 on just the remaining rib and bosses 112.

A cross-member 118 may be advantageously provided, attached between legs 80, 82 and supporting tub bottom 44 at front opening 104. Cross member 118 may, for example, be a length of angle iron or, to avoid sharp edges, a roll-formed shape.

Figures 8, 9:
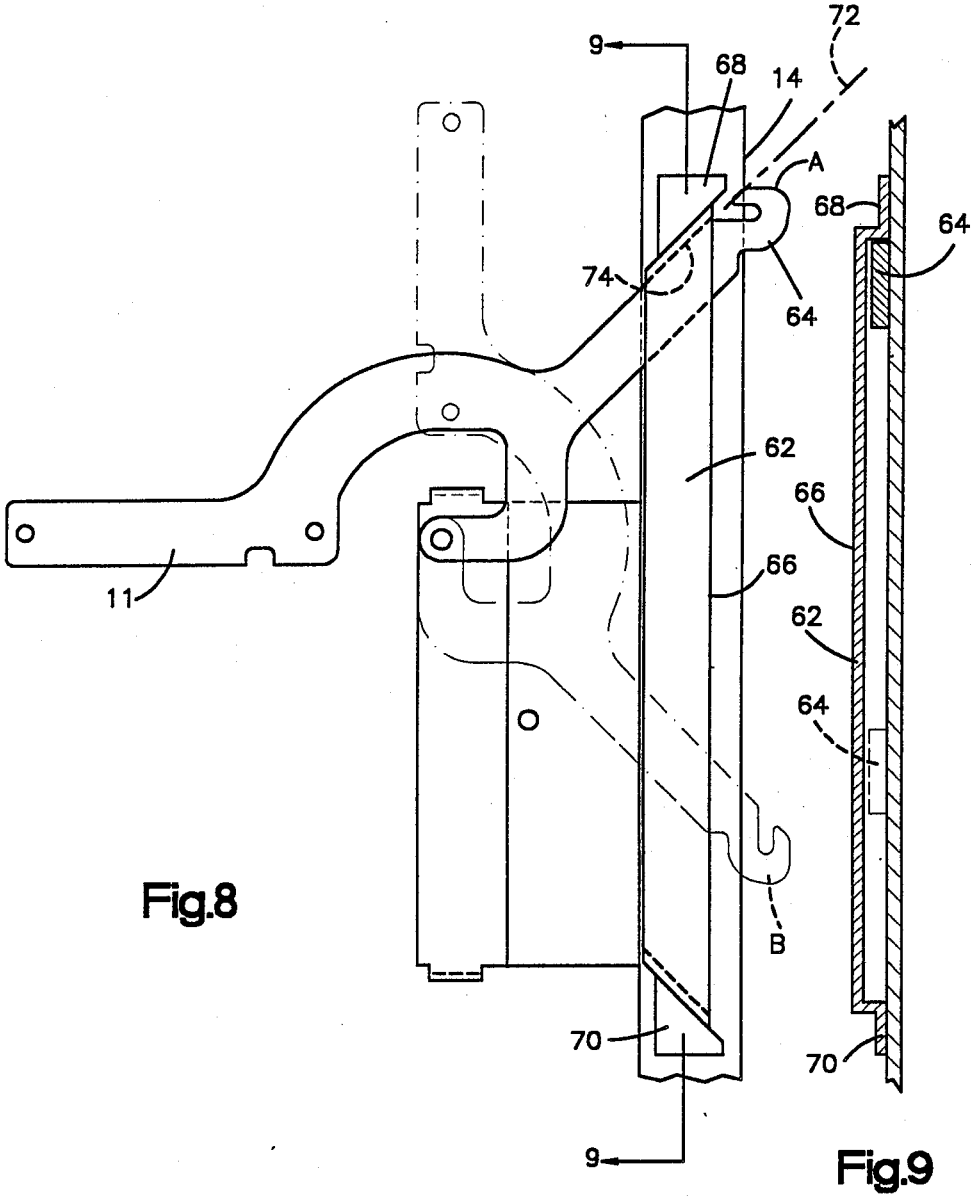
FIG. 8 is a partial side elevation of the dishwasher showing the hinge retaining strip of the invention.
FIG. 9 is a cross-sectional view taken on line 9—9 of FIG. 8.

Referring to FIGS. 8 and 9, a door stop according to the invention is shown. On each side of door frame 14, a strip 62 is attached (by spot welding for example). Strip 62 is mounted astride counterbalance arm 64, shown in an open position A and a closed position B. Strip 62 captures counterbalance arm 64, thereby ensuring that arm 64 engages strip 62 to act as a door stop.

Strip 62 is comprised of a flat portion 66, a top offset arm 68 and a bottom offset arm 70. Strip 62 may be formed, for example, by making parallel offsets in a flat metal strip. Each parallel offset is produced by making two equal opposite angle bends in the metal strip. Because strip 62 is anchored at both ends, bending moments that would be generated by a door stop that simply extended out from the door frame are minimized and therefore strip 62 may be of a thinner material.

In the preferred embodiment, the axis 72 of the offset in the top arm 70 is oriented such that it is parallel to the upper surface 74 of counterbalance arm 64 in open position A. The contact surface between arm 64 and strip 66 is then optimized as the tendency for arm 64 to shear strip 62 is minimized.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. In a dishwasher comprising a box-like tub, said tub having a bottom wall, a top wall, two side walls, a back wall and an open front; and a metal frame supporting said tub above a mounting surface, said frame having a main member supporting a front portion of the tub and a secondary member supporting a remainder of the tub, the improvement comprising said secondary member being formed from and consisting of a single piece, wherein the single piece has a length substantially greater than its width and depth and is formed in a U-shape along its length with a portion of each of the legs of the U additionally formed into arms extending out of the plane of the U.

2. The dishwasher of claim 1, wherein the bight of the U-shape supportively contacts said remainder of the tub and said arms are attached to said main member.

3. The dishwasher of claim 1, wherein the single piece is of a generally right-angle cross section.

4. In a dishwasher comprising a box-like plastic tub, said tub having a bottom wall, a top wall, two side walls, a back wall and an open front; and a metal frame supporting said tub above a mounting surface, said frame having a main member supporting a front portion of the tub and a secondary member supporting a remainder of the tub, the improvement comprising said bottom wall having a plurality of integral support members formed on the bottom thereof, said support members supportedly resting on a top portion of said secondary member, and said bottom wall additionally having an integral retention member formed on the bottom thereof, said retention member being cantilevered from the bottom wall to extend below said top portion of the secondary member, whereby the top portion of said secondary member may be slidably received between said support members and said retention member thereby restraining said tub remainder from up and down movement with respect to the frame.

5. The dishwasher of claim 4, wherein the retention member has a key further extending therefrom and said secondary member has a keyway to receive said key, whereby the tub is restrained from side to side motion with respect to the frame.

6. In a dishwasher having a front support member having two vertical legs; and a front downwardly opening door having a pair of hinge members hingingly attached to respective vertical legs, said hinge members each having an extension, said extension adapted to receive one end of a counterbalance spring, the improvement comprising a pair of strips having a top arm, a bottom arm and a section therebetween, said section having a length substantially greater than that of said arms, said arms of each strip being attached to respective vertical legs astride the extensions, said arms, section and respective vertical legs enclosing the extensions and a portion of said extensions contacting said top arms when the door is in a fully open position, whereby said extensions are confined closely to respective vertical legs and said door is limited in its opening travel.

7. The dishwasher of claim 6, wherein each arm of said strips is formed by an essentially parallel offset in a substantially flat portion of the strip.

8. The dishwasher of claim 7, wherein each parallel offset is formed by two essentially right-angle bends in said strip.

9. The dishwasher of claim 8, wherein said portion of the extensions contacting the upper arms is essentially straight and the axes of the bends in the upper arms are essentially parallel to the respective contact portion.

10. In a dishwasher comprising a box-like plastic tub, said tub having a bottom wall, a top wall, two side walls, a back wall and an open front; and a metal frame supporting said tub above a mounting surface, said frame having a main member supporting a front portion of the tub and a secondary member supporting a remainder of the tub, the improvement comprising:

said secondary member consisting of a single piece having a length substantially greater than its width and depth and being formed in a U-shape along its length with a portion of each of the legs of the U additionally formed into arms extending out of the plane of the U, said arms being attached to said main frame; and said bottom wall having a plurality of integral support members formed on the bottom thereof, said support members arranged in a row generally parallel to the back wall and supportedly resting on the bight portion of the U-shape, and the bottom wall additionally having an integral retention member formed on the bottom thereof, said retention member being cantilevered from the bottom wall to extend below an upper portion of said bight portion, whereby the upper portion of the bight portion of said U-shape may be slidably received between said support members and said retention member, whereby said tub remainder is restrained from up and down and from front to back movement with respect to the frame.

11. The dishwasher of claim 10, wherein at least one of the retention members has a key further extending therefrom and the bight portion of said U-shape has at least one keyway to receive said key, whereby the tub is restrained from motion parallel to the support member row.

12. In a dishwasher comprising a box-like plastic tub, said tub having a bottom wall, a top wall, two side walls, a back wall and an open front, each wall having an outside; and a metal frame supporting said tub above a mounting surface, said frame having a door frame supporting a front portion of the tub and a secondary member supporting a remainder of the tub, the improvement comprising:

said door frame comprising a U-shaped length of metal of angular cross section, the door frame having two legs and a bight, a first angle arm of the length of metal of angular cross section extending out of the plane of the U and a second angle arm of the length of metal of angular cross section generally in the plane of the U and extending towards the interior of the U, said angle arms joining at a vertex and each angle arm having an interior surface and an end opposite the vertex; and said outside of the top and side walls having at least one integrally formed rib extending generally perpendicularly from said top and side walls and further being generally parallel to and disposed near the open front and being generally coextensive therewith, said at least one rib extending from said top and side walls an amount such that said end of said second angle arm bears against the outside of the top and side walls and said interior surface of the first angle arm bears against and is supported by said at least one rib near said end of said first angle arm, whereby said tub may be restrained within said door frame.

13. A dishwasher as in claim 12, further comprising a plurality of bosses associated with said at least one rib, said bosses also being integrally formed with said top and side walls, and each boss being adapted to allow fastening said tub to said door frame.

14. A dishwasher as in claim 12, wherein said door frame further comprises a cross member attached between the legs of the U and being adapted to be in supporting contact with the bottom wall.

* * * * *